US009452098B1

(12) United States Patent
Howard

(10) Patent No.: US 9,452,098 B1
(45) Date of Patent: Sep. 27, 2016

(54) WHEELCHAIR MOUNTABLE TANK CARRIER

(71) Applicant: Mark Howard, Avon, IN (US)

(72) Inventor: Mark Howard, Avon, IN (US)

( * ) Notice: Subject to any disclaimer, the term of this patent is extended or adjusted under 35 U.S.C. 154(b) by 0 days.

(21) Appl. No.: 14/629,560

(22) Filed: Feb. 24, 2015

(51) Int. Cl.
*A61G 5/10* (2006.01)

(52) U.S. Cl.
CPC ..... *A61G 5/10* (2013.01)

(58) Field of Classification Search
CPC ..... A61G 5/10; Y10S 297/04
USPC ..... 224/407, 432, 444, 497, 549; 280/304.1; 297/DIG. 4; 248/421, 248/434–435; D12/133
See application file for complete search history.

(56) References Cited

U.S. PATENT DOCUMENTS 3,970,344 A * 7/1976 Baumann ..... A61G 5/10 248/311.2
4,213,648 A 7/1980 Steichen
4,431,206 A * 2/1984 Pryor ..... A61G 5/10 280/304.1
4,506,903 A 3/1985 Bowermaster
4,583,758 A * 4/1986 Runion ..... A61G 5/006 280/644
4,696,420 A * 9/1987 Kulik ..... A61G 5/10 224/275
D305,629 S 1/1990 Wood
5,219,139 A * 6/1993 Hertzler ..... A61G 5/10 248/276.1
5,288,001 A 2/1994 Locarno
5,340,140 A * 8/1994 Bynum ..... A61G 5/10 224/275
6,273,444 B1 * 8/2001 Power ..... A61G 5/10 280/204
7,188,855 B1 * 3/2007 Thomas ..... A61G 5/10 280/288.4
8,240,529 B1 * 8/2012 Bell, III ..... B60R 9/06 224/497

* cited by examiner

*Primary Examiner* — Justin Larson
*Assistant Examiner* — Scott McNurlen

(57) ABSTRACT

The wheelchair mountable tank carrier comprises a holder and a support. The holder is a container that is adapted to hold an oxygen tank. The holder is attached to the support, which is a structure that is adapted to attach to a wheel chair. The wheelchair mountable tank carrier is designed to collapse with the wheelchair when the wheelchair is collapsed.

8 Claims, 9 Drawing Sheets

WHEELCHAIR MOUNTABLE TANK CARRIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of medical or surgical equipment and fixed medical equipment, more specifically, a tank carrier configured for use with wheelchairs.

Patients with pulmonary diseases such as lung cancer or chronic obstructive pulmonary disease often require oxygen delivered by oxygen tanks which are cylindrically shaped. Oxygen tanks are generally shaped as cylinders with cylinder diameters ranging from two inches to eight inches and cylinder lengths ranging from nine inches to thirty six inches. One of the problems about requiring oxygen is that the oxygen tanks are often bulky and inconvenient to handle. The problem is compounded when the patient is requires a wheelchair because traditional wheel chairs make only limited accommodation for storing the personal items of a patient.

SUMMARY OF INVENTION

The above problems are addressed by the wheelchair mountable tank carrier. The wheelchair mountable tank carrier comprises a holder and a support. The holder is a container that is adapted to hold an oxygen tank. The holder is attached to the support, which is a structure that is adapted to attach to a wheel chair. The wheelchair mountable tank carrier is designed to collapse with the wheelchair when the wheelchair is collapsed.

These together with additional objects, features and advantages of the wheelchair mountable tank carrier will be readily apparent to those of ordinary skill in the art upon reading the following detailed description of the presently preferred, but nonetheless illustrative, embodiments when taken in conjunction with the accompanying drawings.

In this respect, before explaining the current embodiments of the wheelchair mountable tank carrier in detail, it is to be understood that the wheelchair mountable tank carrier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wheelchair mountable tank carrier.

It is therefore important that the claims be regarded as including such equivalent construction insofar as they do not depart from the spirit and scope of the wheelchair mountable tank carrier. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1A:
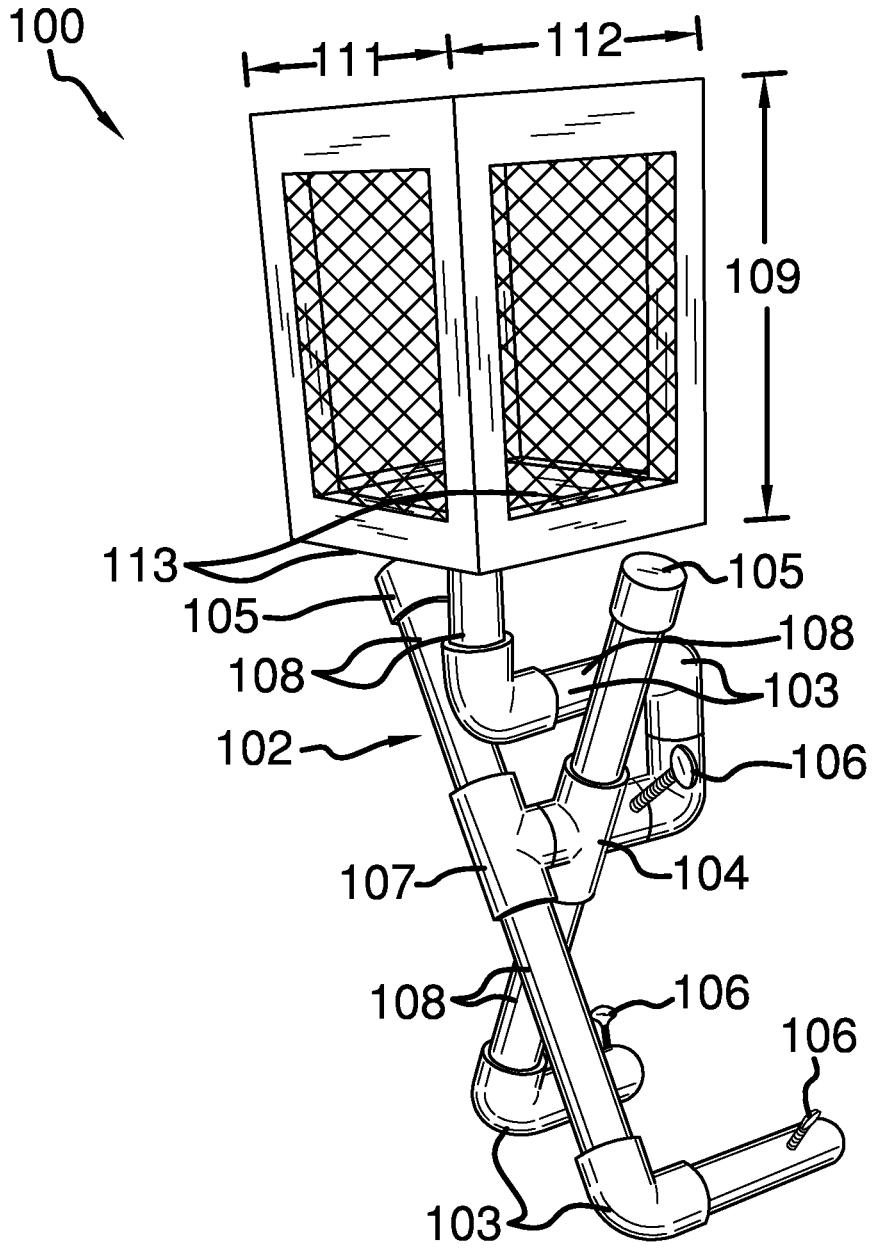
FIG. 1A is a perspective view of an embodiment of the disclosure.
Figure 1B:
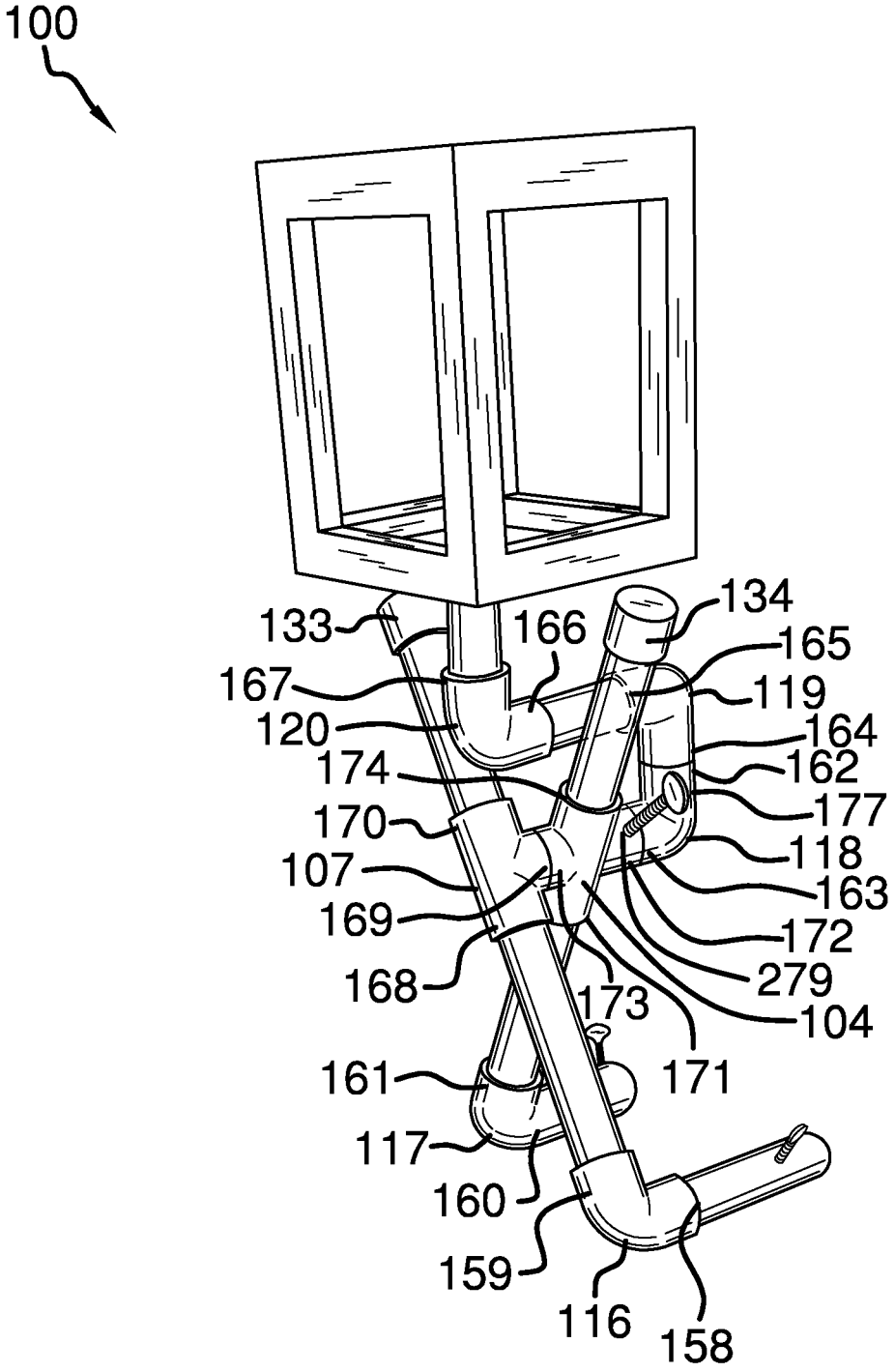
FIG. 1B is another perspective view of an embodiment of the disclosure.
Figure 1C:
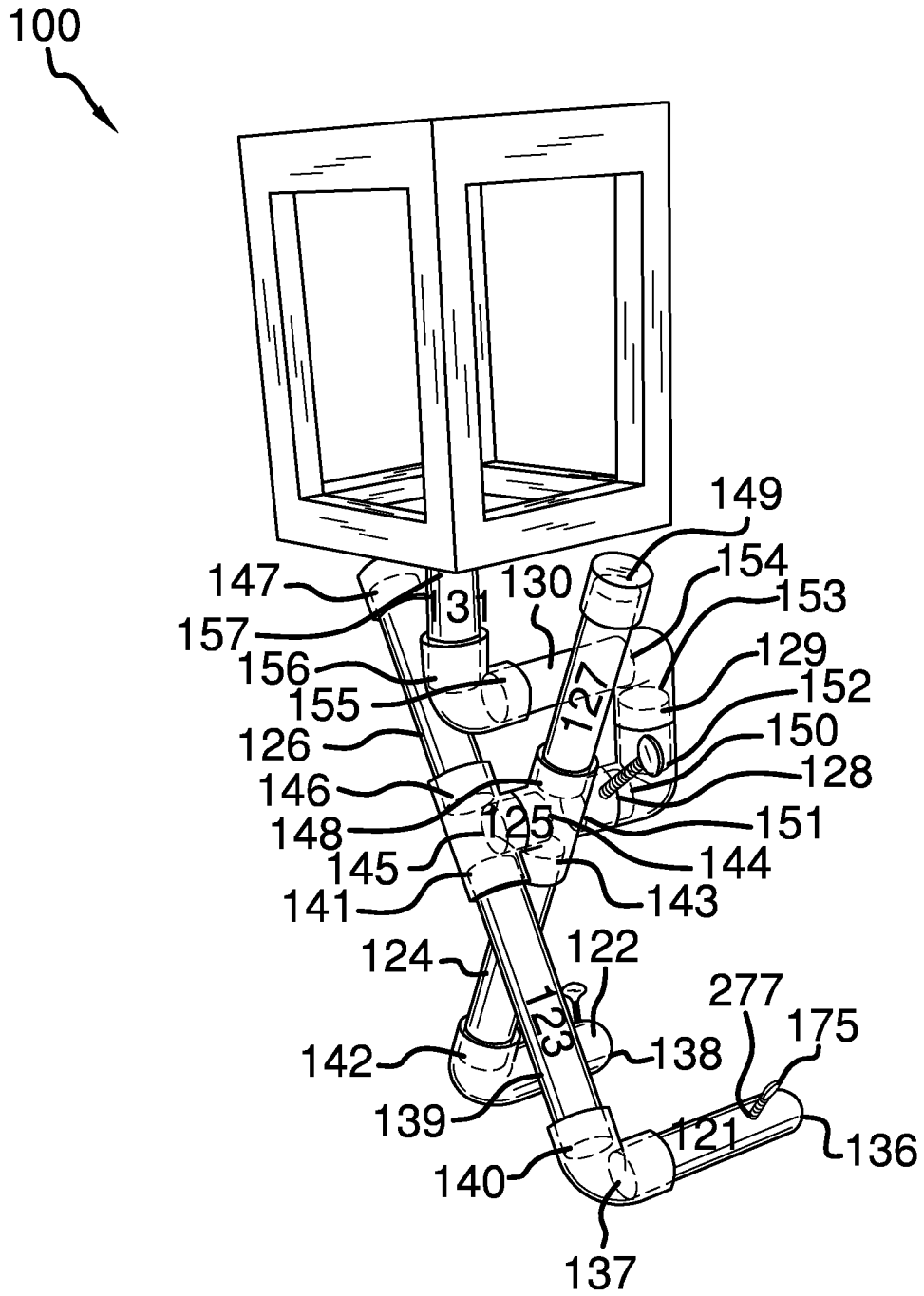
FIG. 1C is another perspective view of an embodiment of the disclosure.
Figure 2:
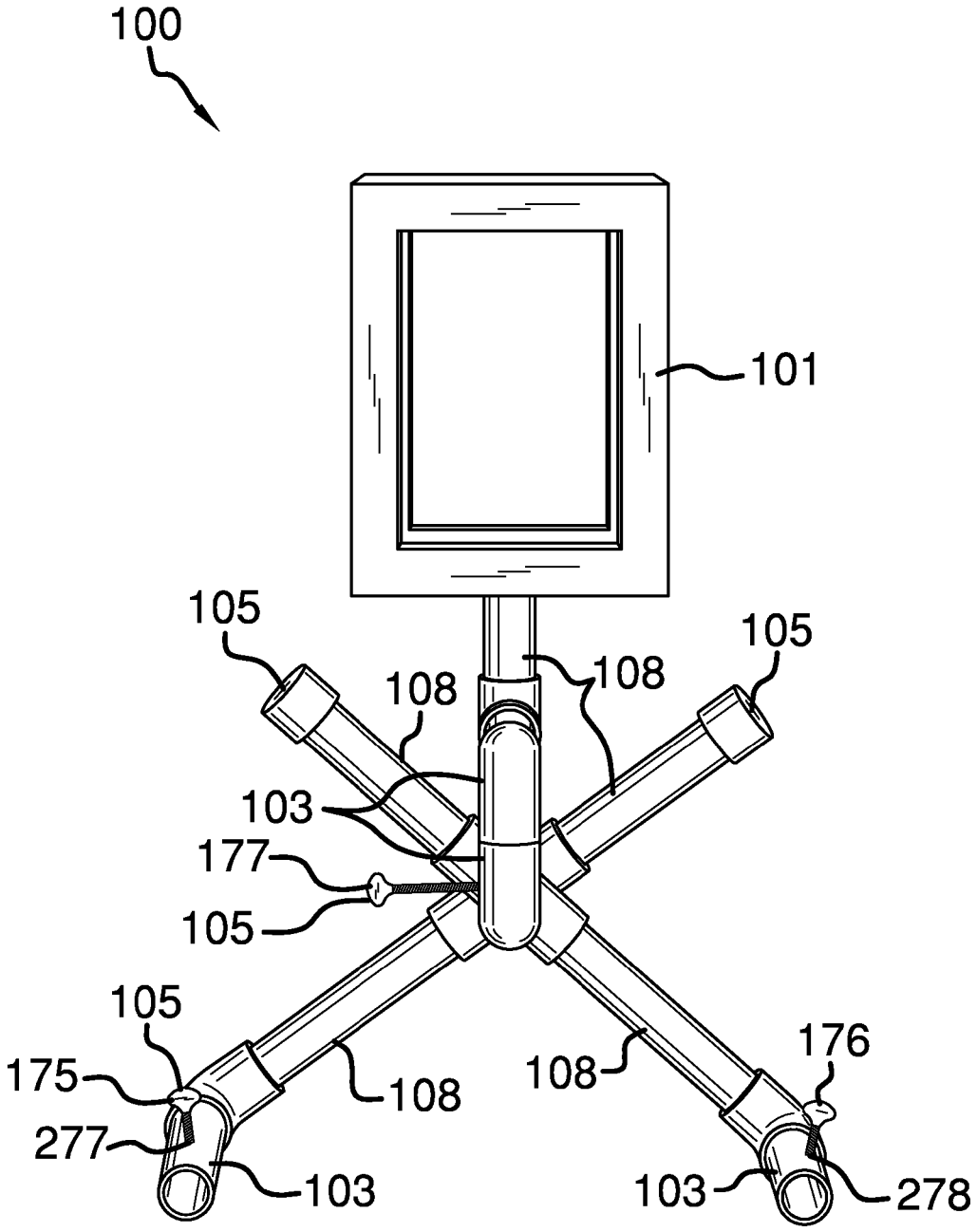
FIG. 2 is a bottom view of an embodiment of the disclosure.
Figure 3:
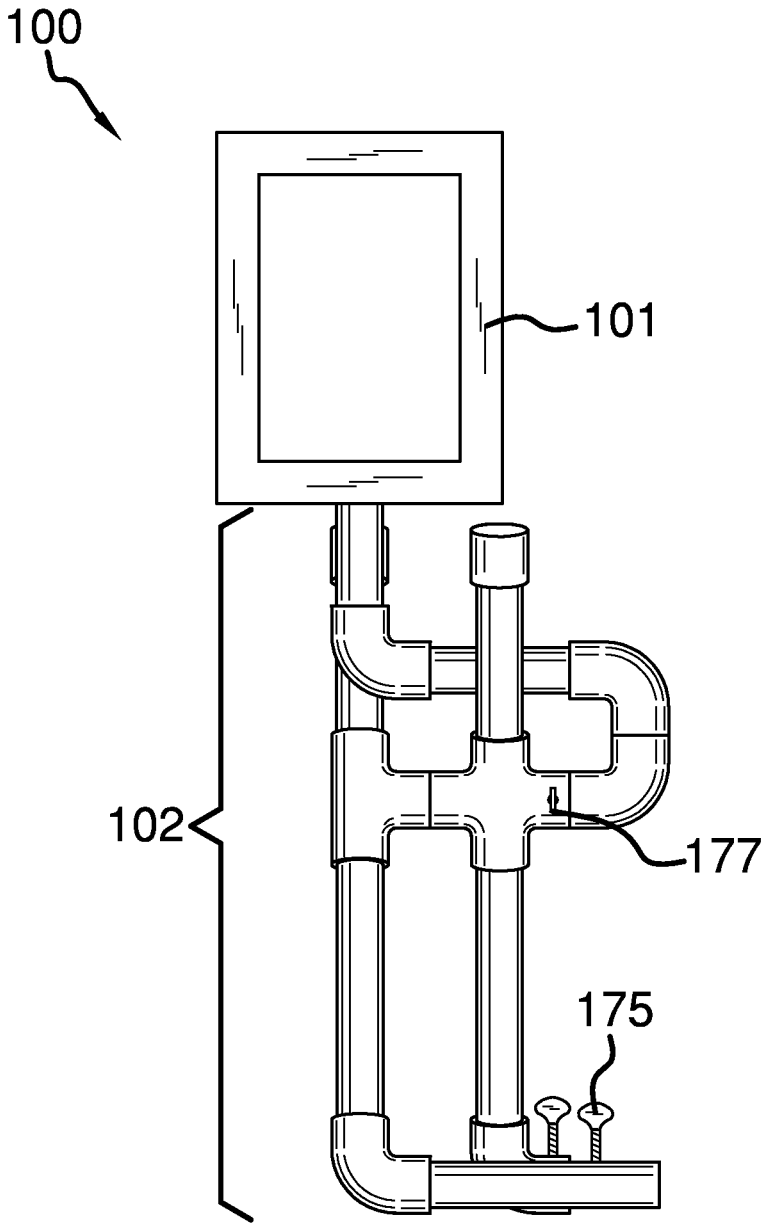
FIG. 3 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 8. The wheelchair mountable tank carrier 100 (hereinafter invention) comprises a holder 101 and a support 102.

The support 102 comprises a plurality of pipes 108, a plurality of elbow fittings 103, a four way fitting 104, a plurality of end caps 105, a tee fitting 107, and a plurality of thumbscrews 106.

In the first potential embodiment of the disclosure, as illustrated in FIGS. 1 through 8, the plurality of pipes 108 comprises a first pipe 121, a second pipe 122, a third pipe 123, a fourth pipe 124, a fifth pipe 125, a sixth pipe 126, a seventh pipe 127, an eighth pipe 128, a ninth pipe 129, a tenth pipe 130, and an eleventh pipe 131. The first pipe 121 is further defined with a first end 136 and a second end 137. The second pipe 122 is further defined with a third end 138 and a fourth end 139. The third pipe 123 is further defined with a fifth end 140 and a sixth end 141. The fourth pipe 124 is further defined with a seventh end 142 and an eighth end 143. The fifth pipe 125 is further defined with a ninth end 144 and a tenth end 145. The sixth pipe 126 is further defined with an eleventh end 146 and a twelfth end 147. The seventh pipe 127 is further defined with a thirteenth end 148 and a fourteenth end 149. The eighth pipe 128 is further defined with a fifteenth end 150 and a sixteenth end 151. The ninth pipe 129 is further defined with a seventeenth end 152 and an eighteenth end 153. The tenth pipe 130 is further defined with a nineteenth end 154 and a twentieth end 155. The eleventh pipe 131 is further defined with a twenty first end 156 and a twenty second end 157.

In the first potential embodiment of the disclosure, as illustrated in FIGS. 1 through 8, the plurality of elbow fittings 103 comprises a first elbow fitting 116, a second elbow fitting 117, a third elbow fitting 118, a fourth elbow fitting 119 and a fifth elbow fitting 120. The first elbow fitting 116 is further defined with a twenty third end 158 and a twenty fourth end 159. The second elbow fitting 117 is further defined with a twenty fifth end 160 and a twenty sixth end 161. The third elbow fitting 118 is further defined with a twenty seventh end 162 and a twenty eighth 163 end. The fourth elbow 119 fitting is further defined with a twenty ninth end 164 and a thirtieth end 165. The fifth elbow 120 fitting is further defined with a thirty first end 166 and a thirty second end 167.

In the first potential embodiment of the disclosure, as illustrated in FIGS. 1 through 8, the plurality of end caps 105 further comprises a first end cap 133 and a second end cap 134. The plurality of thumbscrews 106 comprises a first thumbscrew 175, a second thumbscrew 176, and a third thumbscrew 177. The tee fitting 107 is further defined with a thirty third end 168, a thirty fourth end 169 and a thirty fifth end 170. The four-way fitting 104 is further defined with a thirty sixth end 171, a thirty seventh end 172, a thirty eighth end 173, and a thirty ninth end 174.

In the first potential embodiment of the disclosure, as illustrated in FIGS. 1 through 8, the support 102 is prepared for assembly as follows. A first hole 277 is drilled near the area of the first end 136 of the first pipe 121. A second hole 278 is drilled near the area of the third end 138 of the second pipe 122. A third hole 279 is drilled near the area of the thirty seventh end 172 of the four way fitting 104. The first hole 277, second hole 278, and third hole 279 are sized to receive the first thumbscrew 175, the second thumbscrew 176 and the third thumbscrew 177, respectively.

In the first potential embodiment of the disclosure, as illustrated in FIGS. 1 through 8, the support 102 is assembled as follows. The second end 137 of the first pipe 121 is inserted into the twenty third end 158 of the first elbow fitting 116. The fifth end 140 of the third pipe 123 is inserted into the twenty fourth end 159 of the first elbow fitting 116. The fourth end 139 of the second pipe 122 is inserted into the twenty fifth end 160 of the second elbow fitting 117. The seventh end 142 of the fourth pipe 124 is inserted into the twenty sixth end 161 of the second elbow fitting 117. The sixth end 141 of the third pipe 123 is inserted into the thirty third end 168 of the tee fitting 107.

The eighth end 143 of the fourth pipe 124 is inserted into the thirty sixth end 171 of the four way fitting 104. The ninth end 144 of the fifth pipe 125 is inserted into the thirty eighth end 173 of the four way fitting 104. The tenth end 145 of the fifth pipe 125 is inserted into the thirty fourth end 169 of the tee fitting 107. The eleventh end 146 of the sixth pipe 126 is inserted into the thirty fifth end 170 of the tee fitting 107. The thirteenth end 148 of the seventh pipe 127 is inserted into thirty ninth end 174 of the four way fitting 104. The sixteenth end 151 of the eighth pipe 128 is inserted into the thirty seventh end 172 of the four way fitting 104. The fifteenth end 150 of the eighth pipe 128 is inserted into the twenty eighth end 163 of the third elbow fitting 118. The seventeenth end 152 of the ninth pipe 129 is inserted into the twenty seventh end 162 of the third elbow fitting 118. The eighteenth end 153 of the ninth pipe 129 is inserted into the twenty ninth end 164 of the fourth elbow fitting 119. The nineteenth end 154 of the tenth pipe 130 is inserted into the thirtieth end 165 of the fourth elbow 119. The twentieth end 155 of the tenth pipe 130 is inserted into the thirty first end 166 of the fifth elbow fitting 120. The twenty first end 156 of the eleventh pipe 131 is inserted into the thirty second end 167 of the fifth elbow fitting 120.

To finish the assembly of the first potential embodiment of the disclosure, as illustrated in FIGS. 1 through 8, the first thumbscrew 175 is screwed into the first hole, the second thumbscrew 176 is screwed into the second hole and the third thumbscrew 177 is screwed into the third hole. The holder 101 is attached to the twenty second end 157 of the eleventh pipe 131. The first end cap 133 is placed on the twelfth end 147 of the sixth pipe 126. The second end cap 134 is placed on the fourteenth end 149 of the seventh pipe 127.

If desired, all pipe ends may be glued into the fittings with the following exceptions: the insertion of the ninth end 144 of the fifth pipe 125 into the thirty eighth end 173 of the four way fitting 104 cannot be glued and the insertion of the sixteenth end 151 of the eighth pipe 128 into the thirty seventh end 172 of the four way fitting 104 cannot be glued.

The holder 101 can be attached to the twenty second end 157 of the eleventh pipe 131 in several ways including, but not limited to: 1) using commercially available hardware; or, 2) gluing a third endcap 181, wherein the end cap is threaded, to the bottom 113 of the holder and threading 182 the end of the twenty second end 157 of the eleventh pipe 131 and screwing the third endcap 181 to the threading 182.

In the first potential embodiment of the disclosure, as illustrated in FIGS. 1 through 8, the plurality of pipes 108, the plurality of elbow fittings 103, the four way fitting 104, the plurality of end caps 105, and the tee fitting 107 were polyvinylchloride pipes and fittings. Other suitable materials include, but are not limited to, copper or aluminum piping and fittings. The plurality of thumbscrews 106 are commercially and readily available.

The holder 101 is an open sided crate in the shape of a rectangular block. The holder 101 is further defined with a height 109, a length 110, a width 111, a top 112, and a bottom 113. The dimensions of the holder 101 are as follows: The span of the height 109 ranges from 6 inches to 24 inches. The span of the length 110 ranges from 2.25 inches to 8.25 inches. The span of the width 111 ranges from 2.25 inches to 8.25 inches. The top 112 of the holder 101 is open to allow the insertion and removal of an oxygen tank. The bottom 113 of the holder 101 is a solid surface upon which the oxygen cylinder 115 rests. The option exists to expand the functionality of the holder 101 by attaching netting 114 to the holder 101 to contain other personal items that may be stored in the crate.

In the first potential embodiment of the disclosure, the crate are readily and commercially available. In a second potential embodiment of the disclosure, the holder 101 is formed from as a single piece for plastic. Suitable plastics include, but are not limited to, polyvinylchloride, polyethylene, or polycarbonate. In a third potential embodiment of the disclosure, the holder 101 can be made from PVC pipes and wood that are connected together using commercially available hardware. Commercially available bird netting was used for the optional netting 114. In the first potential embodiment of the disclosure, the optional netting 114 was used.

Figure 4:
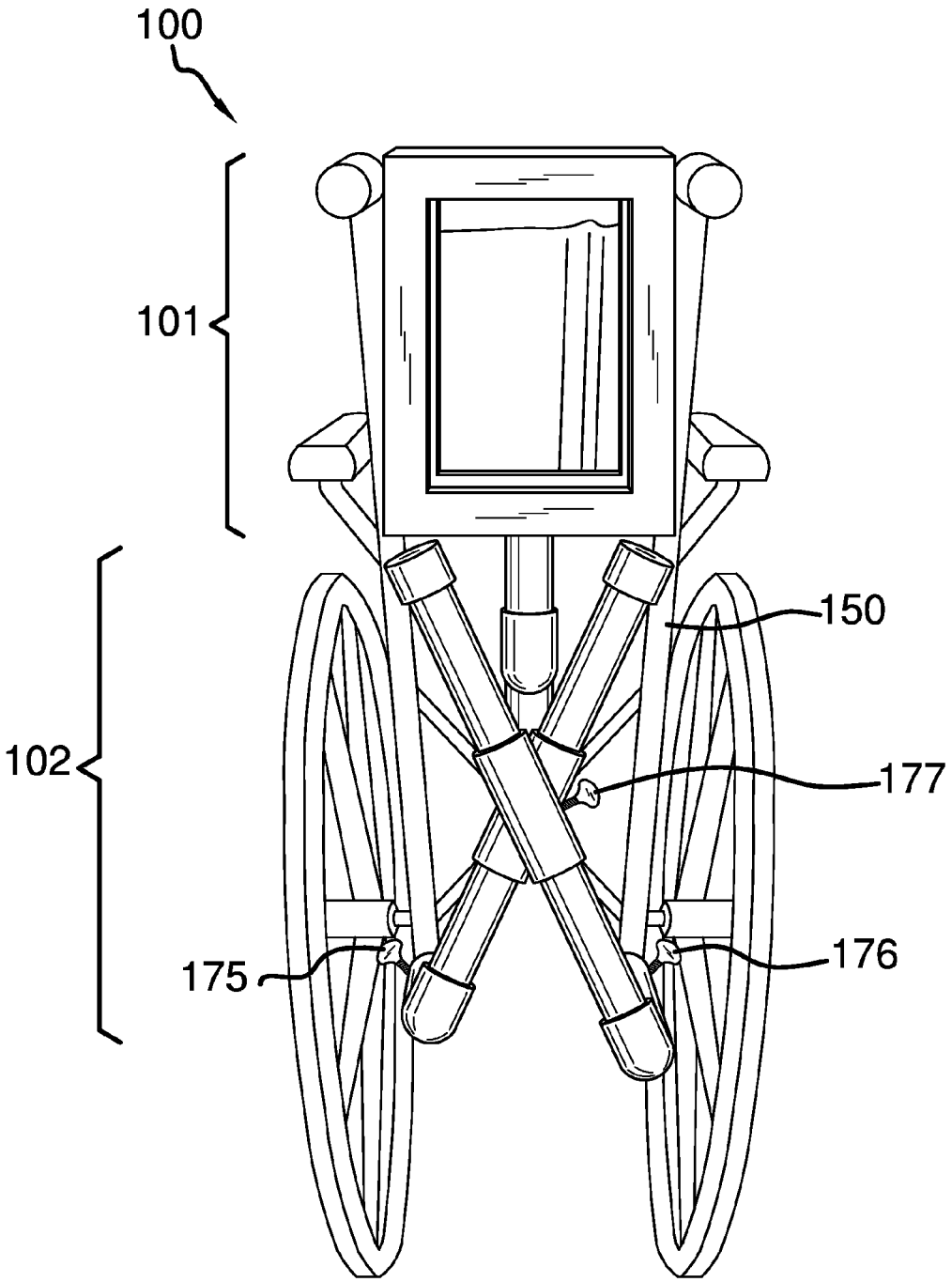
FIG. 4 is a collapsed view of an embodiment of the disclosure.
Figure 5:
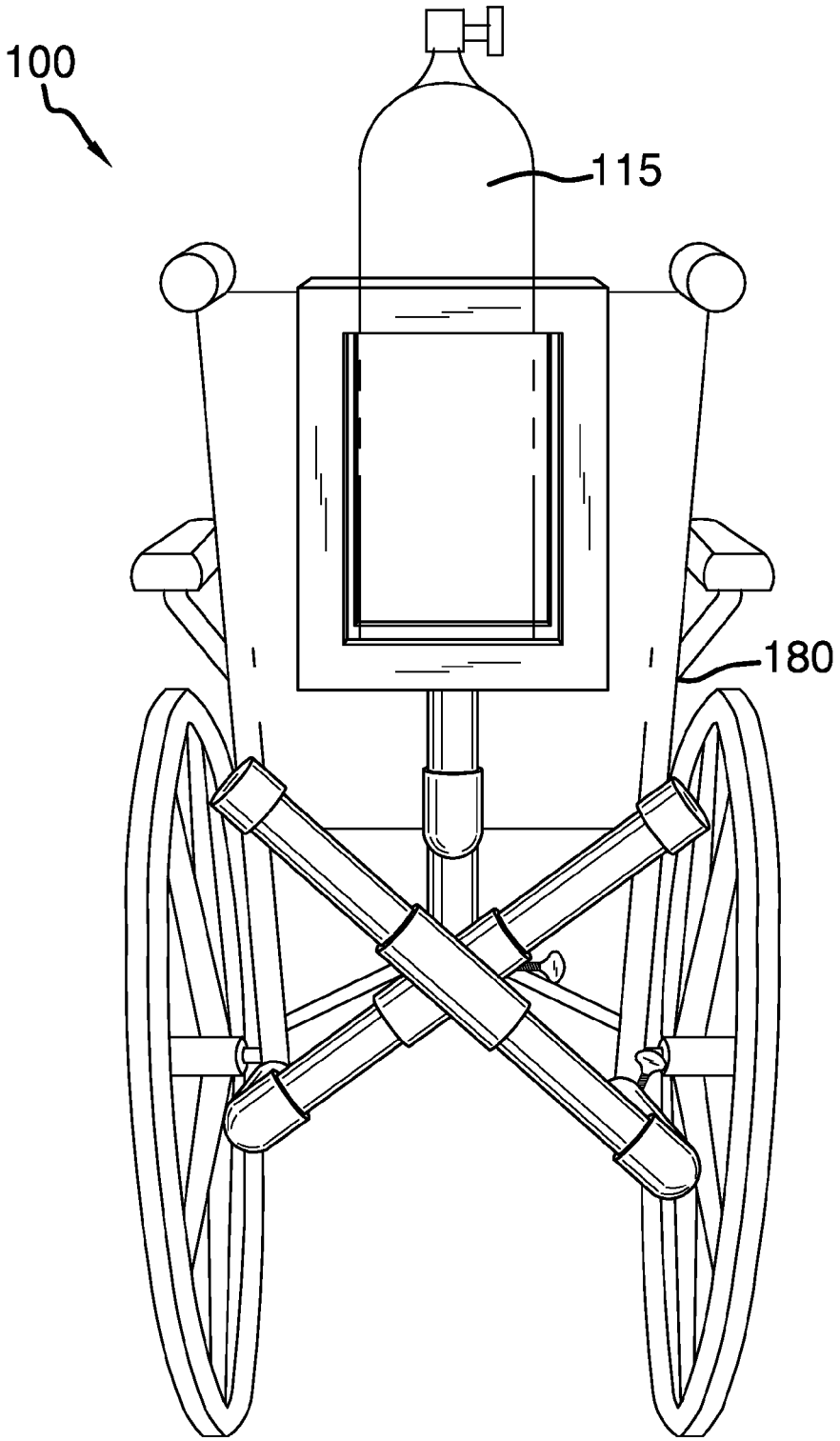
FIG. 5 is an open view of an embodiment of the disclosure.
Figure 6:
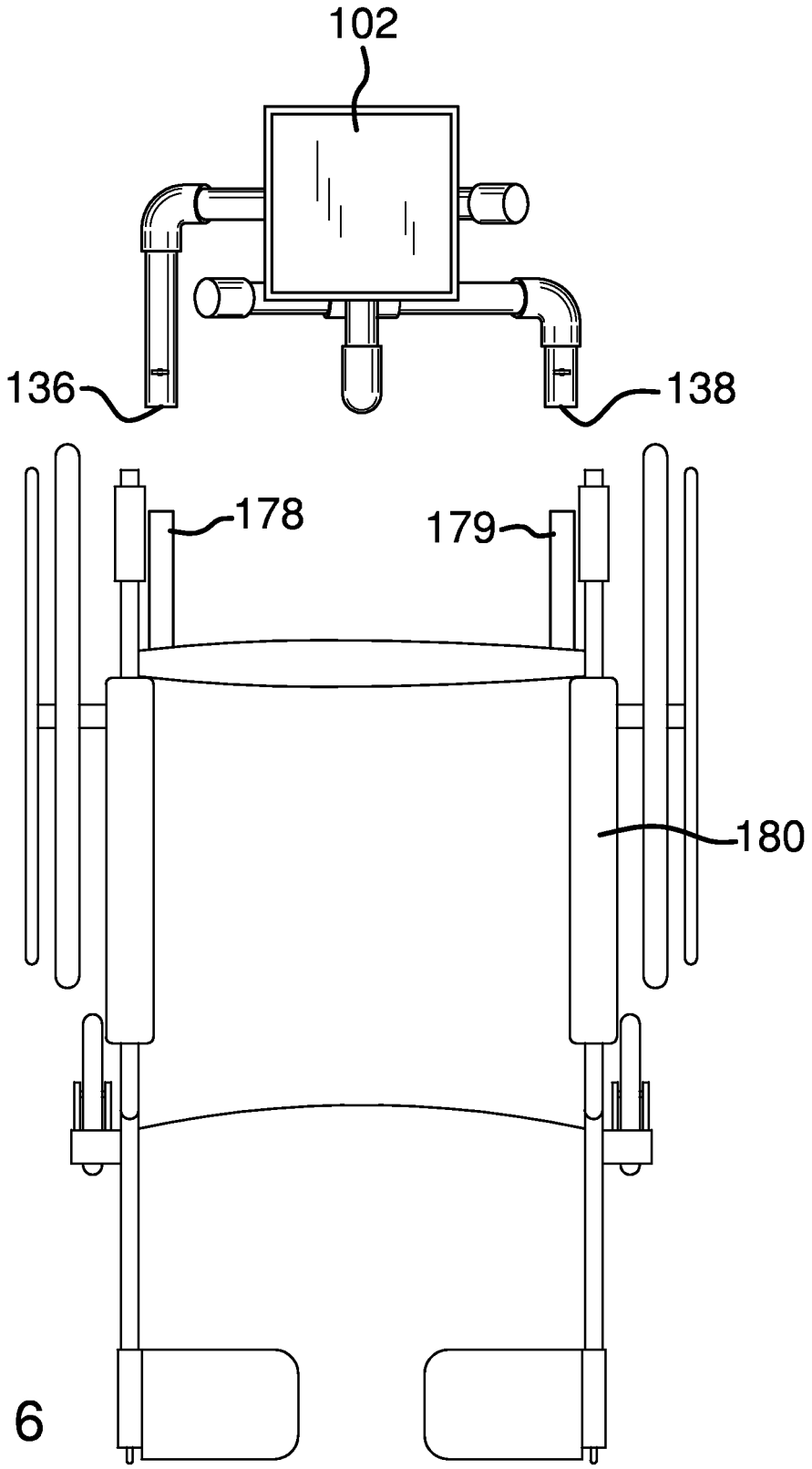
FIG. 6 is an in-use view of an embodiment of the disclosure.
Figure 7:
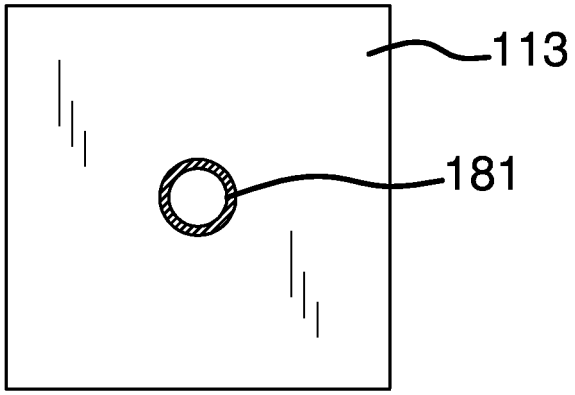
FIG. 7 is a detail view of an embodiment of the disclosure.
Figure 8:
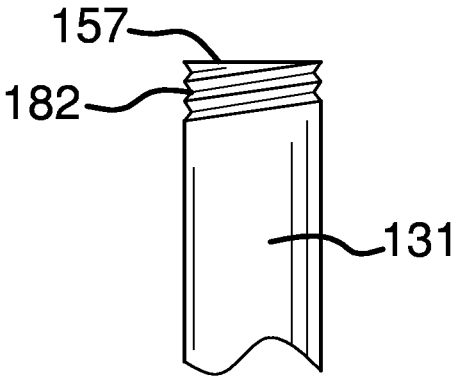
FIG. 8 is a detail view of an embodiment of the disclosure.

To use the invention 100, the first thumbscrew 175, second thumbscrew 176 and third thumbscrew 177 are loosened. The first end 136 of the first pipe 121 is slid over the first tipping lever 178 of the wheelchair 180 and the third end 138 of the second pipe 122 is slid over the second tipping lever 179. The first end 136 of the first pipe 121 is secured in place by tightening the first thumbscrew 175. The third end 138 of the second pipe 122 is secured in place by tightening the second thumbscrew 176. The support is held in place by tightening the third thumb screw 178. To collapse the wheelchair 180, the third thumbscrew is loosened and then the wheelchair can be collapsed normally as shown in FIGS. 4 and 5. By loosening the third thumbscrew, the ninth end 144 of the fifth pipe is able to rotate within the thirty eighth end 173 of the four way fitting 104 and the sixteenth end 151 of the eighth pipe 128 is able to rotate within the thirty seventh end 172 of the four way fitting 104 cannot be glued. This allows the structure comprising the first pipe 121, the third pipe 123, the tee fitting 104 and the sixth pipe 126 to rotate relative to the structure comprising the second pipe 122, the fourth pipe 124, the four way fitting 107, and the seventh pipe 127. This relative rotation reduces the overall width of the structure allowing the wheelchair 180 to collapse.

In the specification and claims, the following definition was used:

Tipping Lever: As used in this disclosure, a tipping lever is a rod of a wheelchair 180 that extends from underneath the wheelchair 180 in the direction behind the patient. Using the wheels of the wheelchair 180 as a pivot point, the tipping lever acts as a lever that makes it easier to move the wheelchair 180 over obstacles such as curbs. A wheelchair 180 is typically outfitted with two tipping levers so that either foot can be used.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wheelchair-mountable tank carrier comprising
a holder and support;
the carrier is adapted for use with a wheel chair;
wherein the carrier is adapted to collapse;
wherein the carrier is adapted for use with an oxygen tank;
wherein the support comprises a plurality of pipes, a plurality of elbow fittings, a four way fitting, a plurality of end caps, a tee fitting, and a plurality of thumbscrews;
wherein the holder is further defined with a height, a length, a width, a top, and a bottom;
wherein the height spans 6 inches to 24 inches;
wherein the length spans 2.25 inches to 8.25 inches;
wherein the width ranges from 2.25 inches to 8.25 inches;
wherein the top of the holder is open to allow the insertion and removal of an oxygen tank;
wherein the bottom of the holder is a solid surface;
wherein netting is attached to the holder;
wherein the plurality of pipes comprises a first pipe, a second pipe, a third pipe, a fourth pipe, a fifth pipe, a sixth pipe, a seventh pipe, an eighth pipe, a ninth pipe, a tenth pipe, and an eleventh pipe;
wherein the first pipe is further defined with a first end and a second end;
wherein the second pipe is further defined with a third end and a fourth end;
wherein the third pipe is further defined with a fifth end and a sixth end;
wherein the fourth pipe is further defined with a seventh end and an eighth end;
wherein the fifth pipe is further defined with a ninth end and a tenth end;
wherein the sixth pipe is further defined with an eleventh end and a twelfth end;
wherein the seventh pipe is further defined with a thirteenth end and a fourteenth end;
wherein the eighth pipe is further defined with a fifteenth end and a sixteenth end;
wherein the ninth pipe is further defined with a seventeenth end and an eighteenth end;
wherein the tenth pipe is further defined with a nineteenth end and a twentieth end;
wherein the eleventh pipe is further defined with a twenty first end and a twenty second end;
wherein the plurality of elbow fittings comprises a first elbow fitting, a second elbow fitting, a third elbow fitting, a fourth elbow fitting and a fifth elbow fitting;
wherein the first elbow fitting is further defined with a twenty third end and a twenty fourth end;
wherein the second elbow fitting is further defined with a twenty fifth end and a twenty sixth end;
wherein the third elbow fitting is further defined with a twenty seventh end and a twenty eighth end;
wherein the fourth elbow fitting is further defined with a twenty ninth end and a thirtieth end;
wherein the fifth elbow fitting is further defined with a thirty first end and a thirty second end;
wherein the plurality of end caps further comprises a first end cap and a second end cap;
wherein the plurality of thumbscrews comprises a first thumbscrew, a second thumbscrew, and a third thumbscrew;
wherein the tee fitting is further defined with a thirty third end, a thirty fourth end and a thirty fifth end;
wherein the four way fitting is further defined with a thirty sixth end, a thirty seventh end, a thirty eighth end, and a thirty ninth end;
wherein a first hole is drilled at the first end of the first pipe;
wherein a second hole is drilled at the third end of the second pipe;
wherein a third hole is drilled at the thirty seventh end of the four way fitting;
wherein the first hole, the second hole, and the third hole are sized to receive the first thumbscrew, the second thumbscrew and the third thumbscrew, respectively;

wherein the second end of the first pipe is inserted into the twenty third end of the first elbow fitting;

wherein the fifth end of the third pipe is inserted into the twenty fourth end of the first elbow fitting;

wherein the fourth end of the second pipe is inserted into the twenty fifth end of the second elbow fitting;

wherein the seventh end of the fourth pipe is inserted into the twenty sixth end of the second elbow fitting;

wherein the sixth end of the third pipe is inserted into the thirty third end of the tee fitting;

wherein the eighth end of the fourth pipe is inserted into the thirty sixth end of the four way fitting;

wherein the tenth end of the fifth pipe is inserted into the thirty fourth end of the tee fitting;

wherein the eleventh end of the sixth pipe is inserted into the thirty fifth end of the tee fitting;

wherein the thirteenth end of the seventh pipe is inserted into thirty ninth end of the four way fitting;

wherein the fifteenth end of the eighth pipe is inserted into the twenty eighth end of the third elbow fitting;

wherein the seventeenth end of the ninth pipe is inserted into the twenty seventh end of the third elbow fitting;

wherein the eighteenth end of the ninth pipe is inserted into the twenty ninth end of the fourth elbow fitting;

wherein the nineteenth end of the tenth pipe is inserted into the thirtieth end of the fourth elbow;

wherein the twentieth end of the tenth pipe is inserted into the thirty first end of the fifth elbow fitting;

wherein the twenty first end of the eleventh pipe is inserted into the thirty second end of the fifth elbow fitting.

2. The carrier according to claim 1 wherein the first thumbscrew is screwed into the first hole;

wherein the second thumbscrew is screwed into the second hole;

wherein the third thumbscrew is screwed into the third hole.

3. The carrier according to claim 2 wherein the holder is attached to the twenty second end of the eleventh pipe.

4. The carrier according to claim 3 wherein a third endcap is attached to the bottom of the holder and the twenty second end of the eleventh pipe is attached to the third endcap.

5. The carrier according to claim 4 wherein the first end cap is placed on the twelfth end of the sixth pipe; wherein the second end cap is placed on the fourteenth end of the seventh pipe.

6. The carrier according to claim 1 wherein the first end of the first pipe is adaptively slid over a first tipping lever of the wheelchair and the third end of the second pipe is adaptively slid over a second tipping lever of the wheelchair.

7. The carrier according to claim 6 wherein the first end of the first pipe is secured in place by tightening the first thumbscrew;

wherein the third end of the second pipe is secured in place by tightening the second thumbscrew.

8. The carrier according to claim 1 wherein a first end of the first pipe is adaptively slid over the first tipping lever of the wheelchair and a third end of the second pipe is adaptively slid over a second tipping lever.

* * * * *